US005455465A

United States Patent [19]

House

[11] Patent Number: 5,455,465

[45] Date of Patent: Oct. 3, 1995

[54] RAPID TRANSIT CAR ELECTRICAL COUPLING APPARATUS AND METHOD

[75] Inventor: Lawrence T. House, Whitby, Canada

[73] Assignee: Alcatel Canada, Inc., Weston, Canada

[21] Appl. No.: 148,679

[22] Filed: Nov. 4, 1993

[51] Int. Cl.[6] ..... H02J 3/06; B61G 5/06; B61D 17/00

[52] U.S. Cl. ..... 307/69; 213/1.3; 213/1.6; 105/4.3

[58] Field of Search ..... 307/43; 171/97; 213/1.3; 105/4.3; 191/4; 439/363

[56] References Cited

U.S. PATENT DOCUMENTS

| | | | |
|---|---|---|---|
| 2,153,247 | 12/1937 | Hamilton | 171/97 |
| 3,472,396 | 10/1969 | Frill | 213/1.3 |
| 3,606,030 | 9/1971 | Frill | 213/1.3 |
| 3,842,987 | 10/1974 | Prada | 213/1.3 |
| 4,767,351 | 8/1988 | Patel et al. | 439/363 |
| 4,892,204 | 1/1990 | Lumbis | 213/1.6 |
| 4,953,726 | 9/1990 | Loutan | 213/1.3 |
| 4,957,208 | 9/1990 | Ta | 213/1.3 |

*Primary Examiner*—A. D. Pellinen
*Assistant Examiner*—Albert Paladini
*Attorney, Agent, or Firm*—Ware, Fressola, Van Der Sluys & Adolphson

[57] ABSTRACT

A train car with mirror image electrical couplings having mirror image halves at each end for connecting train lines in each car to corresponding train lines in adjacent cars, regardless of the end-to-end orientation of the car, has selected pairs of train lines connected to corresponding pairs of switches for each end of the car for switching the halves of each selected pair of train lines between one or the other halves of the mirror image electrical couplings, depending on the orientation of the car.

5 Claims, 8 Drawing Sheets

RAPID TRANSIT CAR ELECTRICAL COUPLING APPARATUS AND METHOD

TECHNICAL FIELD

This invention relates to transit (subway) type vehicles having mechanical and electrical couplers therebetween and, more particularly, method and apparatus for electrically coupling cars regardless of the end-to-end orientation of any particular car in a train of cars.

BACKGROUND OF THE INVENTION

Rapid transit systems such as the New York City subways, London Underground subways, the San Francisco Municipal Railway and BART systems are all powered by electricity supplied either through third rail shoes or pantagraphs reaching overhead wires, supplying power for driving motors, heating, lighting and air conditioning.

This invention concerns a parallel electrical wiring system, called train lines, carrying alarm signals throughout the train, to announce loss of braking air pressure, a wheel bearing hot box, or other malfunctions, to indicate status such as "all doors closed", or to power public address speakers, or to control air conditioning or heat, "turn interior lights on", etc. These train lines extend the length of each car, and are connected to each adjacent car through an electrical "coupler", i.e., a connector having a plurality of electrical connection points in "left" or "right" types for mating with a coupler in a coupled car. The electrical connection points are usually called "pins" regardless of type of connection.

Various manufacturers design cars having a fixed coupler at both ends which permit coupling at either end, without regard to the orientation of the car with respect to other cars in the train. A train is typically made up of several cars connected together. Each car typically has a motor and a driver's panel at each end. The train can be driven from any car, provided it is placed at the front of the train. Each electrical coupler is of the type which has two halves, each half being a mirror image of the other half. This type of electrical coupler permits similar cars to be coupled together in any 180° orientation.

Some electrical couplers with mirror image pairs of coupler pins have only one physical housing for both left and right pairs of pins. The most common arrangement, however, is for each mirror image half to be in a separate physical housing called a coupler head or electrical coupler head and is usually identified as right or left (as if someone inside the train were looking out). The electrical connection points comprise two types of physically mating metal devices. Both mating halves are usually called "pins" regardless of type. The coupler "pins" perform a function which is analogous to the function performed by the sockets and pins in a manually installed connector; however, the coupler "pins" are physically different. "Pins" are usually of fixed and moveable types wherein moveable types are backed by springs and fixed pins are solidly mounted. Fixed pins mate to moveable pins. Sometimes, coupler heads do not have all the same type of pins. That is, the same coupler head (mirror image half) may have both fixed and moveable pins.

As mentioned, train lines are wires which run from one end of a train to the other, through the electrical couplers. Train lines must be connected to a right and a left coupler pin at both ends of the car. This is necessary, according to the present state of the art, to allow the function of the train line to be unchanged if the car is rotated 180°. This requires four coupling connections per train line per car.

Coupler pins are expensive and must be kept to a relatively small number for mechanical reasons. There is also, on occasion, the need to add new train lines on existing cars which, it may unfortunately be found, do not have enough coupler pins available. It should be noted that the above-mentioned four pin coupling requirement does not exist for cars that are only allowed to couple in the same 180° orientation, or for special train lines which change function when the car is rotated. It should also be noted that sometimes cars are grouped in groups of two or three or more with permanent connections between cars. In that case the coupler heads at the ends of the group are treated as if at the ends of a single car at least for purposes of temporary coupling (non-permanent attachment).

DISCLOSURE OF INVENTION

An object of the present invention is to allow train lines of any type to be implemented using only one coupler pin at each end of a car or vehicle of a train.

Another object of the present invention is to reduce the number of coupler pins used for electrical connection of cars or vehicles of a train.

According to the present invention, each train line is connected to a pair of switches at each end of the car for switching the train line between one or the other of the mirror image left or right coupler head halves of the coupler, depending on the orientation of the car.

In further accord with the present invention, a pair of train lines can be switched between the coupler head halves of the couplings, depending on the orientation of the car.

The advantage of this approach is that the pair of train lines share a matched pair of left and right coupler pins at each end of the car so that only two coupler pins are required per train line, one at each end of the car. In other words, a selected pair of train lines may be switched between the mirror image halves of the couplings, depending on the orientation of the car.

According further to the present invention, a pair of additional train lines are required, one for connecting a relay to a power source.

According further to the present invention, a second reference train line is required in each car to which is connected at least one reference switch for switching voltage thereto. In that case, only one reference switch in the train is permitted to be actuated.

In still further accord with the present invention, the relay may be a latching relay interconnected between the reference train lines. In this way, the latched condition will be retained even in the presence of a loss of power to the relay.

These and other objects, features and advantages of the present invention will become more apparent in light of the following detailed description of a best mode embodiment thereof, as illustrated in the accompanying drawing.

BEST MODE FOR CARRYING OUT THE INVENTION

Figure 2:
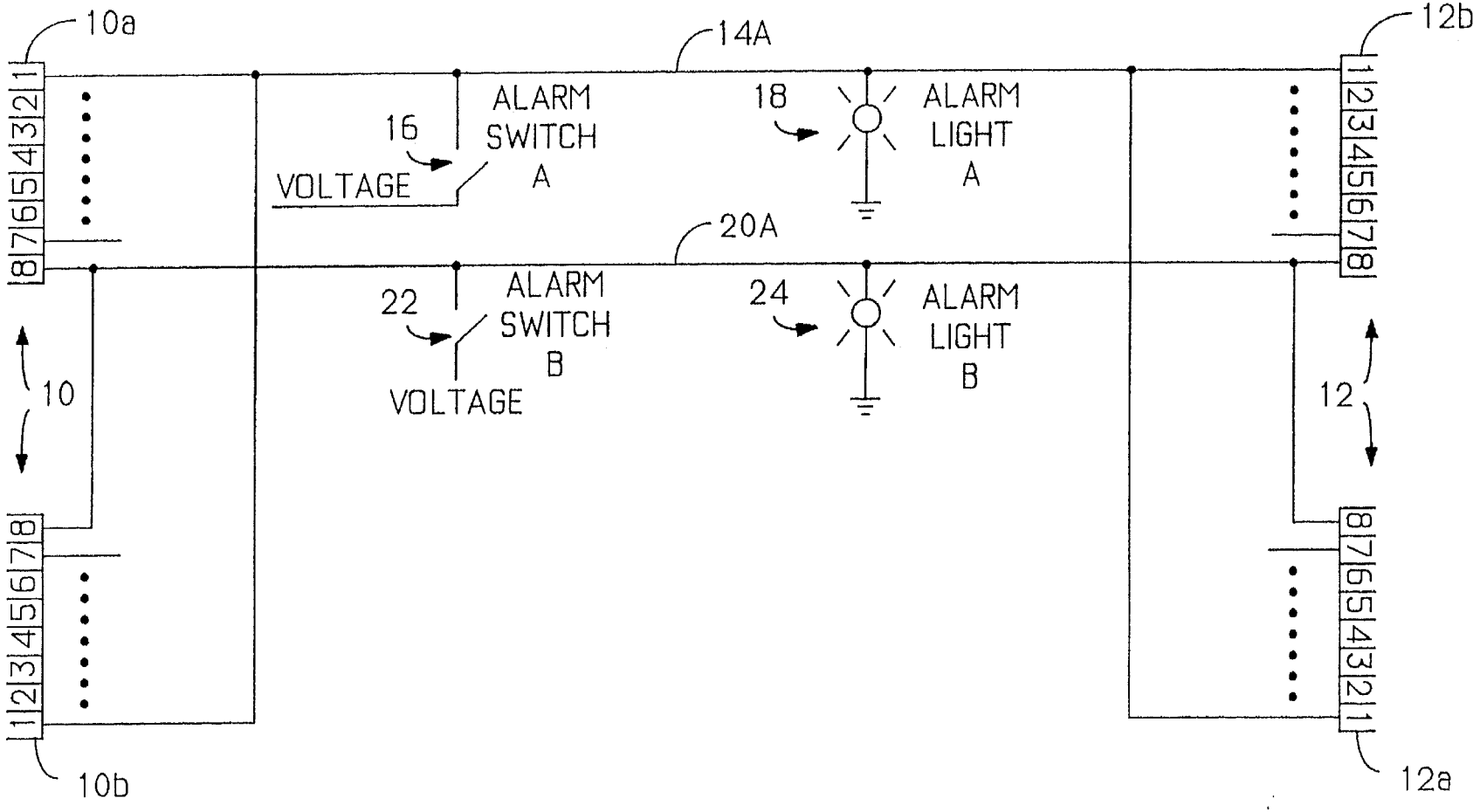
FIGURE 2 (PRIOR ART)
FIG. 2 shows a prior art method of wiring a car of a multi-car train.

Turning first to the prior art wiring method of FIG. 2, the wiring of a pair of train lines of a car is shown schematically from end to end thereof by reference to the left and right hand sides of the Figure. At the left hand side is shown a coupler 10 having two, mirror-image halves 10*a*, 10*b* which halves take the form of a plural right pin 10*a* and a plural left pin 10*b*, respectively. If FIG. 2 is viewed as a top view of the car, and if one were to stand on the ground facing the left hand end of the car in order to view the coupler 10, the "right" coupler head 10*a* would be oriented horizontally with pins 1–8 arranged, as shown, from left to right in ascending order. The left hand coupler head 10*b*, from the same point of view, has its receptacles arranged horizontally in descending order from 8 to 1 from left to right, as shown. The two coupler head halves 10*a*, 10*b* would typically be arranged side by side at the same horizontal level. Of course, the illustration in FIG. 2 is simplified with only eight matching pairs of pins shown in mirror image halves. In reality, most cars would tend to have a much larger number of pins, on the order of sixty or seventy pins on each coupler head. Associated with the electrical coupling is a mechanical coupling (not shown) for joining the cars mechanically.

On the right hand side of FIG. 2 is shown an electrical coupler 12 that is the same as the coupler 10 except having an orientation 180° different from the orientation of coupler 10. The coupler 12 has a right electrical coupler head half 12*a* and a left electrical coupler head half 12*b*. These coupler head halves are located on opposite longitudinal sides of the car as compared to the coupler head halves 10*a*, 10*b* on the other end.

The prior art wiring shown in FIG. 2 achieves end-to-end interchangeability by wiring together all of the similarly numbered pins at both ends into a same electrical node. For example, pin number 1 of coupler head half 10*a* is electrically connected to a pin number 1 in coupler head half 10*b* by means of a node 14A which is also connected to a pin 1 in coupler head half 12*b* and a pin 1 in coupler head half 12*a*. Associated with the node 14A in the car shown in FIG. 2 may be an alarm switch (A) 16 connected to a voltage source available in the car which would typically be DC (although not restricted thereto) supplied by a low voltage battery (24 VDC to 100 VDC nominal). An alarm condition existing in the car illustrated in FIG. 2 might cause the alarm switch (A) 16 to close thereby energizing node 14A and an alarm light (A) 18 tied to a ground or common line in the car which may be connected to other cars in the train by means of the couplers 10, 12 at available pins thereof (not shown). The alarm light (A) 18 may be located at a control panel (not shown) within the car illustrated in FIG. 2. According to the prior art, if the orientation of each car in the train were identical, the coupling 10 on the left hand side of FIG. 2 would couple to a coupler 12 on the right hand side of an adjacent car and the coupler 12 on the right hand side of the car of FIG. 2 would couple to a coupler 10 on the left hand side of an adjacent car.

Figure 3:
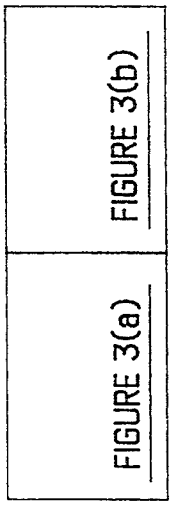
FIG. 3 shows a three car train of the prior art, each car wired as shown in FIG. 2, with the first and third cars oriented in the same direction and the middle car reversed 180°.
Figure 3A:
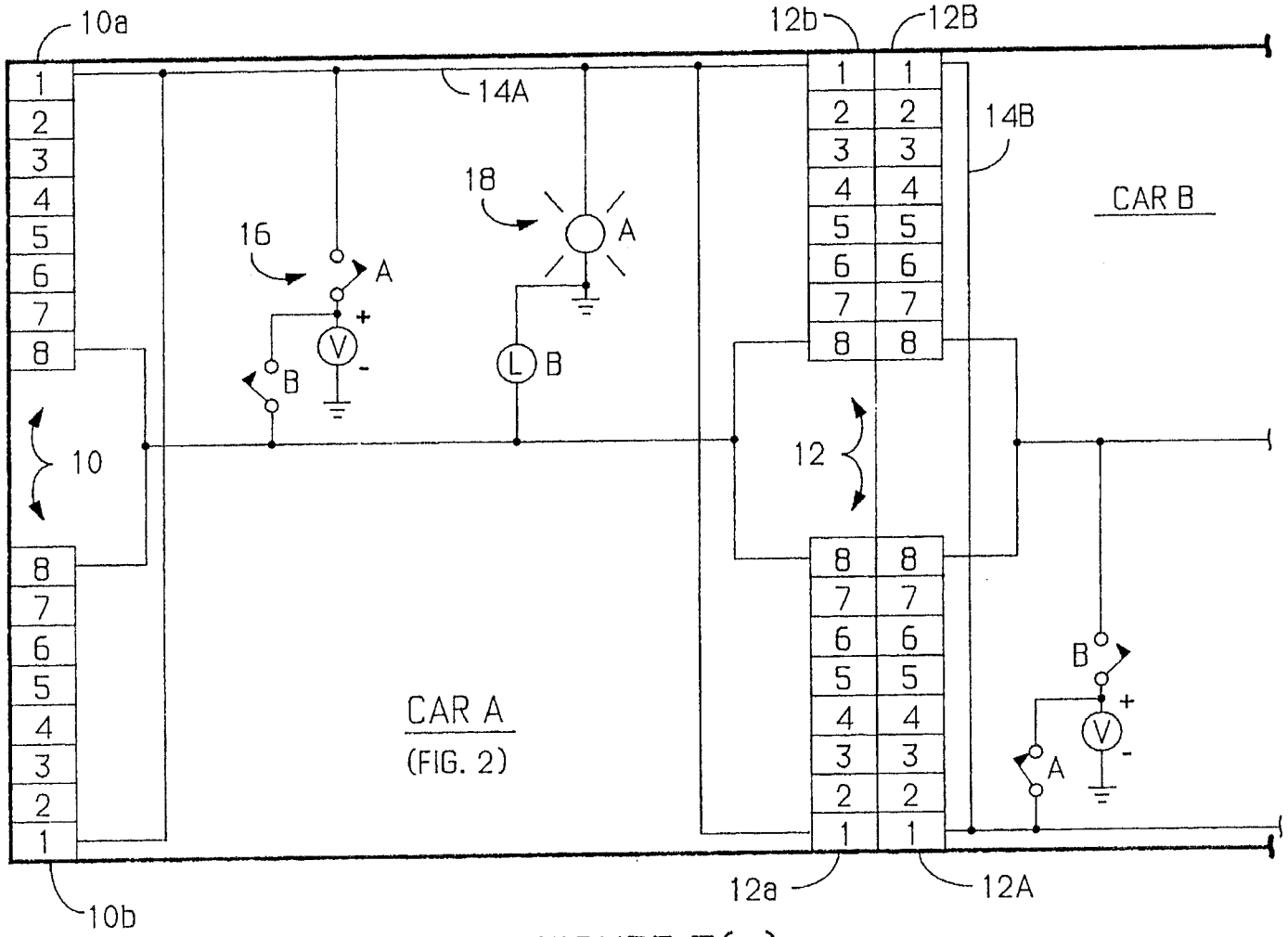
FIGURE 3(a) (PRIOR ART)
Figure 3B:
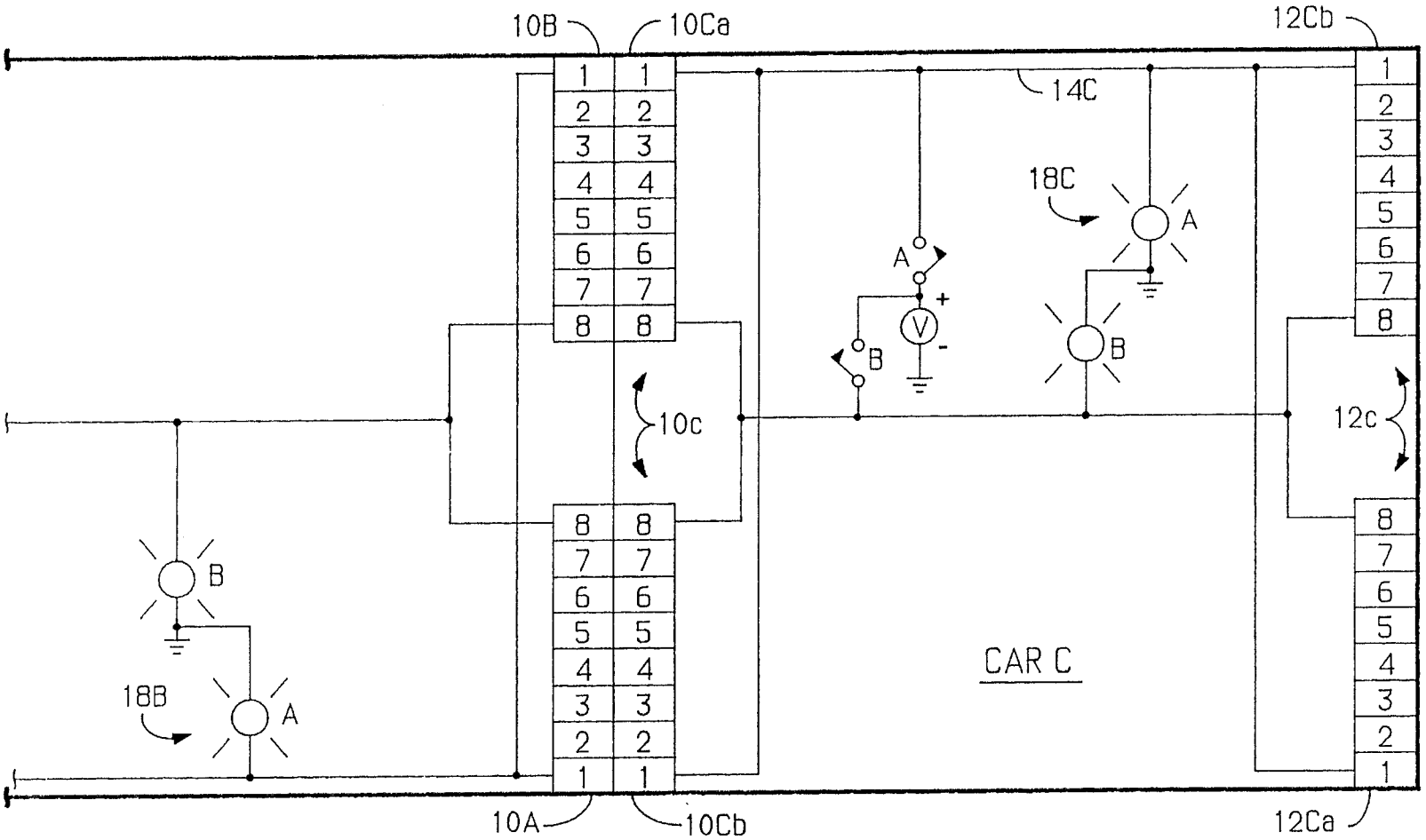
FIGURE 3(b) (PRIOR ART)
Figure 4A:
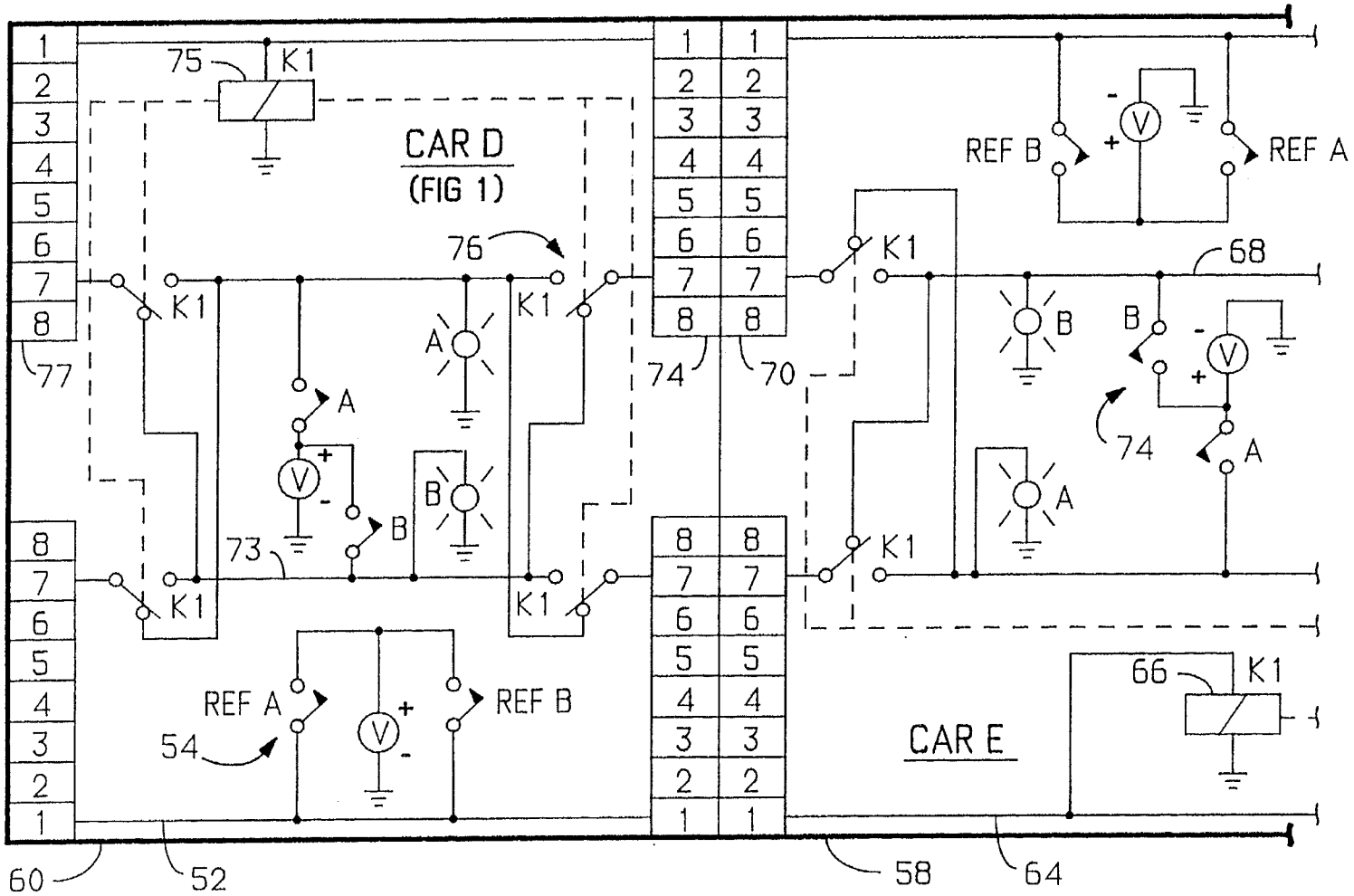
Figure 4B:
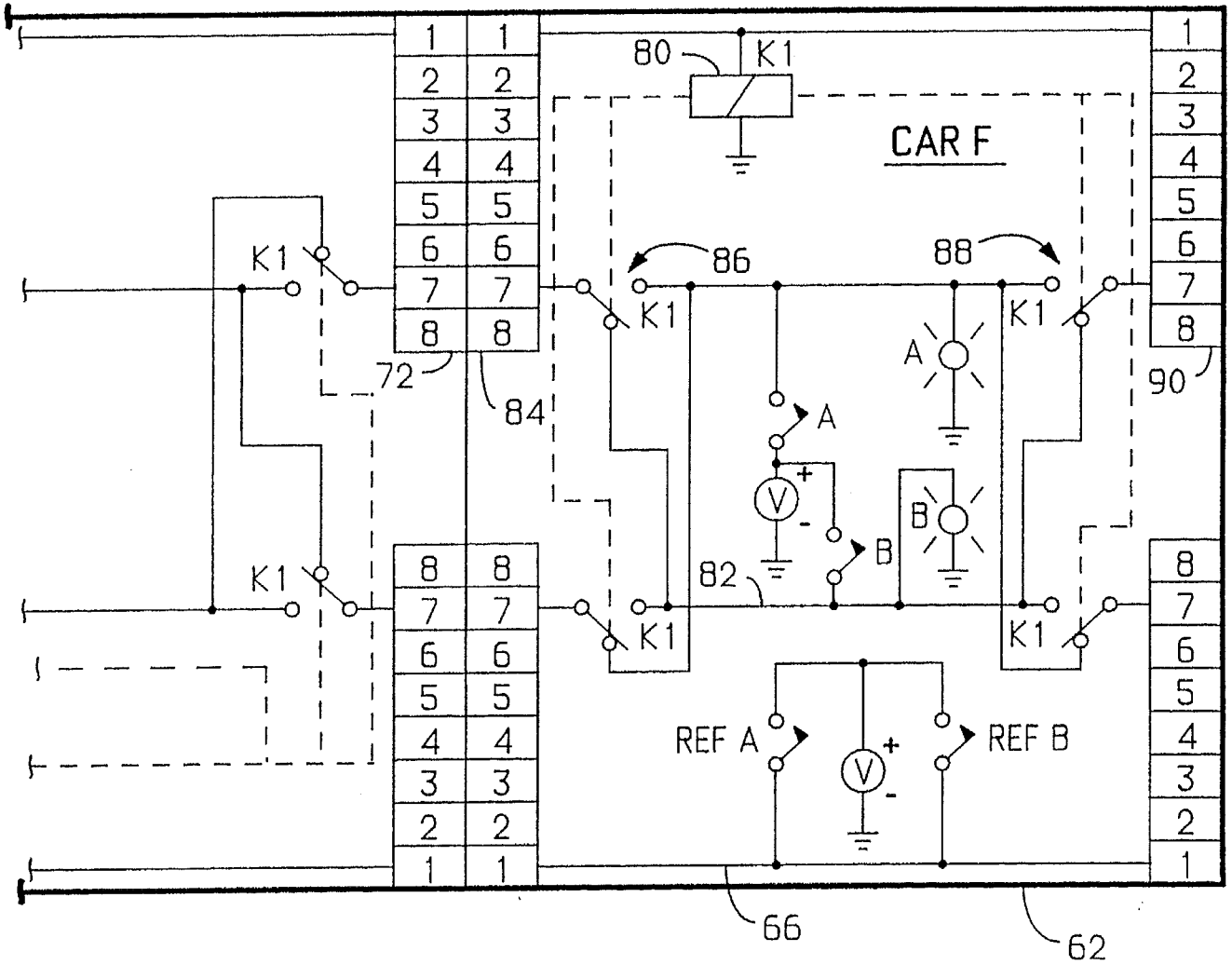

The use of the wiring scheme shown in FIG. 2 whereby all of the pins labeled with the number 1 are tied in common, however, allows the cars that make up a train to be oriented or rotated in any 180° orientation with respect to each other, as shown for example in FIG. 3 where three cars are shown forming a train and where similar function train lines are interconnected properly.

The leftmost car in FIG. 3 is the car illustrated in FIG. 2. It is labeled "CAR A". A middle car ("CAR B") is wired in the same way as CAR A but is rotated 180° such that the formerly right hand coupler (12A, 12B) is located on the left hand side of the car as viewed from above in FIG. 3 and the formerly left hand coupler (10A, 10B) is oriented on the right hand side of the car, as viewed from the top, as in FIG. 3. It will be observed, according the prior art of FIG. 3, that a common node 14B within CAR B successfully connects an alarm lamp 18B to the energized line 14A from CAR A through a pin number 1 of a plug 12B, thereby illuminating the proper lamp (A) at a control panel within CAR B. It is also noted that coupler head half 12A has a pin number 1 which also connects up to node 14A through a pin number 1 of coupler head half 12*a*.

A CAR C has an orientation the same as CAR A with couplers similarly labeled 10C, 12C and having a common node 14C connected to coupler pins with the number "one". A lamp 18C is illuminated by the node 14C which is in turn energized by the node 14B which is itself energized by the node 14A in response to the switch 16 closing in the presence of an alarm condition in CAR A. Thus, according to the prior art, despite the reversed orientation of CAR B, all of the lamps 18, 18B, 18C are energized by the closing of the switch 16 in response to an alarm condition in CAR A.

Referring back to the prior art connection of FIG. 2, it will be observed that a second node 20A is illustrated connected to each pin with the number "eight" in a manner similar to that already disclosed in connection with the node 14A. An alarm switch (B) 22 is connected to the voltage source and an alarm light (B) 24 is connected to the common or ground. This is also shown in FIG. 3 and is replicated in CAR B and CAR C as well to show that a plurality of nodes will be hooked up to the couplings at each end of each car as described. These all work in the same way as already described and may include a plurality of 60 or 70 such circuits, more or less, as is common in the prior art.

It will be observed, however, that the arrangement illustrated in FIGS. 2 and 3 require four pins for each train line in each car. This can be an expensive proposition and it would be very useful to be able to reduce this number in some way.

Figure 1:
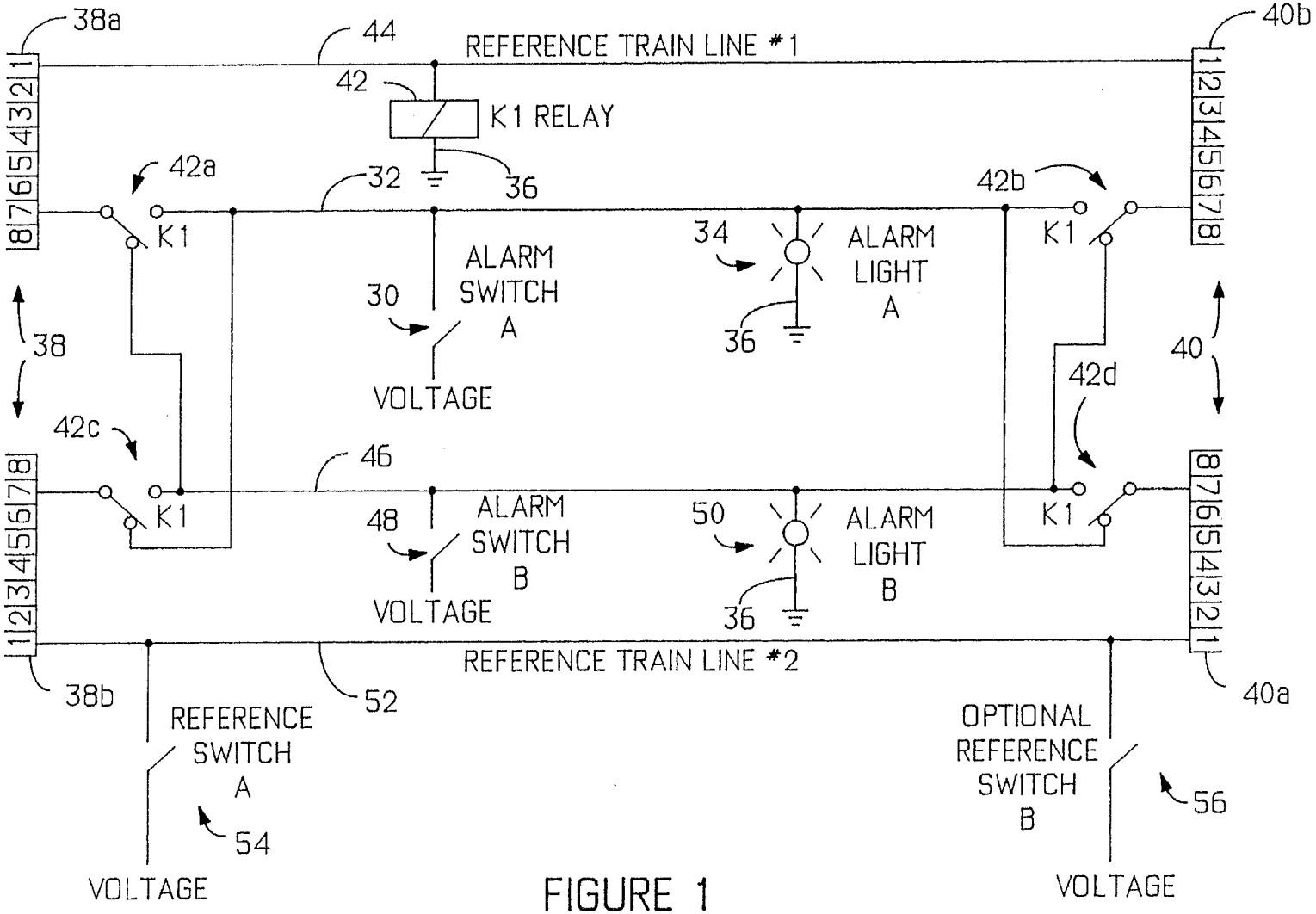
FIG. 1 shows the wiring in one car of a multi-car train, according to an embodiment of the present invention.

Referring now to FIG. 1, according to the teachings of the present invention, the number of pins required for the above-described couplers can be significantly reduced. In FIG. 1, an alarm switch (A) 30 is illustrated being connected to a voltage at one end and to a node 32 at the other end. An alarm light (A) 34 is also attached to the node 32 at one end and to a ground 36 at the other end. According to the invention, instead of having the node 32 connected to a pair of pins in both a left coupler 38 and a right coupler 40, the node 32 is only capable of being connected for a given orientation of the car to either a pin 7 in a coupler head half 38*a* and a pin 7 in a coupler head half 40*b* or connected to a pin 7 in a coupler head half 38*b* and a pin 7 in a coupler head half 40*a*. The particular mirror-half side coupler head halves (38*a*, 40*b* or 38*b*, 40*a*) to which the node 32 is connected depends on whether or not a relay (K1) coil 42 is energized by a voltage on a reference train line 44 (also called reference train line number 1). It is immaterial for the proper hookup of the node 32 whether the relay is energized or not. If we assume the K1 relay is shown in a deenergized state and having a plurality of K1 form C contacts 42*a*, 42*b*, 42*c*, 42*d* shown in the positions corresponding to the deenergized state of the coil 42, then the node 32 will be connected to the coupler head half 38*b* and the coupler head half 40*a* through the contacts 42*c* and 42*d* in the positions shown in FIG. 1. If, on the other hand, the K1 relay coil 42 is energized by a voltage on the line 44 then all of the K1 contacts shown in FIG. 1 will assume positions opposite to that shown and the node 32 will instead be connected to the couplers 38, 40 by means of the coupler head half 38*a* and the coupler head half 40*b*. In either case, only two coupler pins, one at each end of the car are all that is required to form continuity for a given train line between adjacent cars, regardless of the orientation of the car itself.

A second node 46 is shown in FIG. 1 to illustrate how the two-position contacts of the K1 relay are utilized to share the total of four pins that were formally used for a single circuit in the prior art illustrated by FIG. 2. In the case illustrated in FIG. 1, as previously explained, the node 32 utilizes either pin 7 of coupler head halves 38*a* and 40*b*, or pin 7 of coupler head halves 38*b* and 40*a*, depending on the deenergized or energized state of the K1 relay, respectively. Conversely, a node 46 which is connected to an alarm switch (B) 48 and an alarm light (B) 50, is connected to a pin 7 in the coupler head half 38*a* and coupler head 40*b* for the deenergized state of the K1 relay coil 42 and, for the energized state of the relay coil 42, the node 46 is connected to the couplers 38, 40 by way of pin 7 of coupler head half 38*b* and pin 7 of coupler head half 40*a*.

It will of course be evident that additional relay contacts or additional relays or both may be provided to accommodate additional nodes or pairs of nodes.

Figure 4:
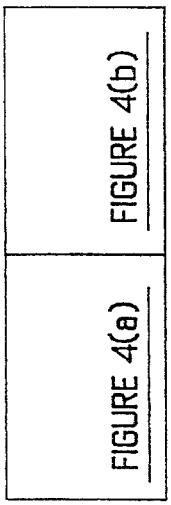
FIG. 4 shows a three car train, according to the present invention, each car wired according to the method shown in FIG. 1, the first and third cars oriented in the same direction with the middle car oriented in a direction 180° opposite from the direction of the first and third cars.

In addition to the reference train line 44, a second reference train line 52 is shown in FIG. 1. It may be connected to a reference switch (A) 54 and to an optional reference switch (B) 56 which are each connected to the above-described voltage that feeds alarm switches 30, 48. For a given train, according to the invention, only a reference switch in one car is permitted to be closed so that the energized reference train line 52, in that one car, can be used to feed all other cars to which it is connected. Depending on the orientation of the individual cars with respect to each other in the train, the energized voltage on the line 52 will be effective for energizing K1 relay coils in cars oriented differently than itself and for not energizing K1 coils in cars oriented the same as itself. FIG. 4 shows the former case where a middle car (E) 58 is oriented 180° from adjoining car (D) 60 and adjoining car (F) 62. If, for example, the car 60 is the car illustrated in FIG. 1 and reference switch (A) 54 is closed (opposite to that shown) so as to energize reference train line 52, then a reference train line 64 in car (E) 58 will be energized as will a K1 relay coil 66 connected thereto. Similarly, a reference train line 66 in car (F) 62 will be energized but without any effect on any relay coil in that car 62. Following the above-described rule, only one reference switch 54 is allowed to be closed for a given train such as the train 60, 58, 62 of FIG. 4. For the given example of FIG. 4, the only car in which the K1 relay is energized is car (E) 58. In that case, all of the K1 contacts within that car will be in a position opposite that of the deenergized coil position shown. In that case, a node 68 is connected to pin 7 in coupler head half 70 and to pin 7 in coupler head half 72. The node 68, as shown, is associated with a B alarm switch 74 which, upon closing, will energize the node 68 and an associated lamp in each car through couplers coupling the cars. For the particular example, the node 68 is coupled to a node 73 in car (D) 60 by means of pin 7 in coupler head halves 70, 74 because a K1 relay coil 75 is deenergized and an associated contact 76 is in the position shown. The node 73 is also connected to a pin 7 in a coupler head half 77 in case an additional car is coupled to the train. Similarly, the car (F) 62 is oriented the same as the car (D) 60 and its K1 coil 80 is deenergized and its K1 contacts are in the position illustrated. Therefore, a node 82 is connected to pin 7 in a coupler head half 84 by way of a contact 86. A contact 88 connects the node 82 to pin 7 in a coupler head half 90 in case another car is coupled to the train at the right hand side of car (F) 62. For this example, it will be understood that the node 68, though in a car that is oriented 180° differently from its adjoining cars is properly coupled to those adjoining cars so that all of the alarm switches and lamps associated with a particular alarm condition are electrically joined together. And, according to the teachings of the present invention, this is done with only one pin at each end of a particular car for a particular type of alarm. It is only necessary to add two pins at each end of each car to accommodate the two extra reference train lines 44, 52 (FIG. 1) in each car. So the number of pins required in the prior art is essentially halved except for those two added pins at each end of the car. The example of FIG. 4 as explained in connection with the B type alarm can also be worked through for an A type alarm without difficulty and will not be explained further here. Of course, many additional alarm nodes may be added to each car according to the need.

Figure 6:
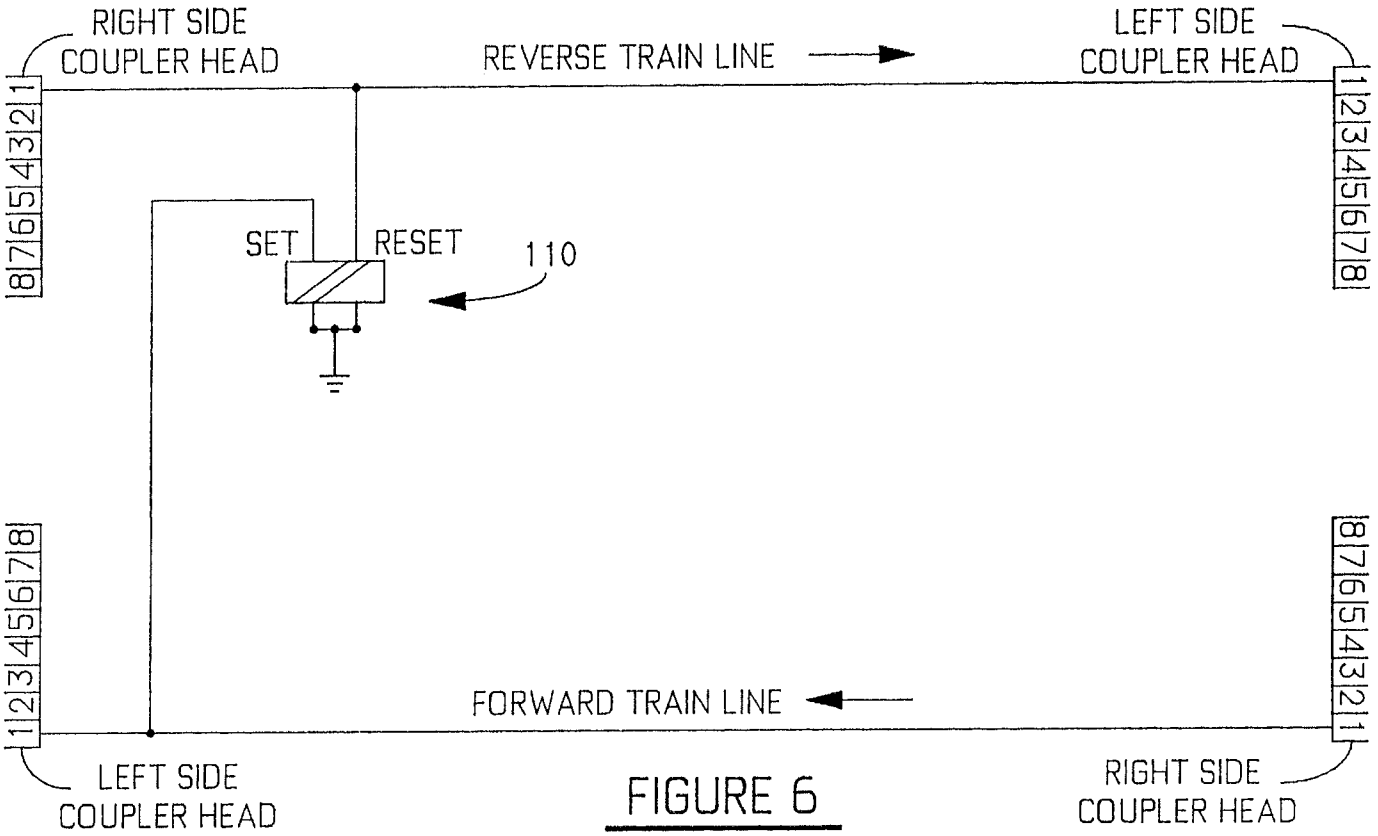
FIGS. 5 and 6 show additional car wiring techniques, according to the present invention and embodiments thereof.
Figure 5:
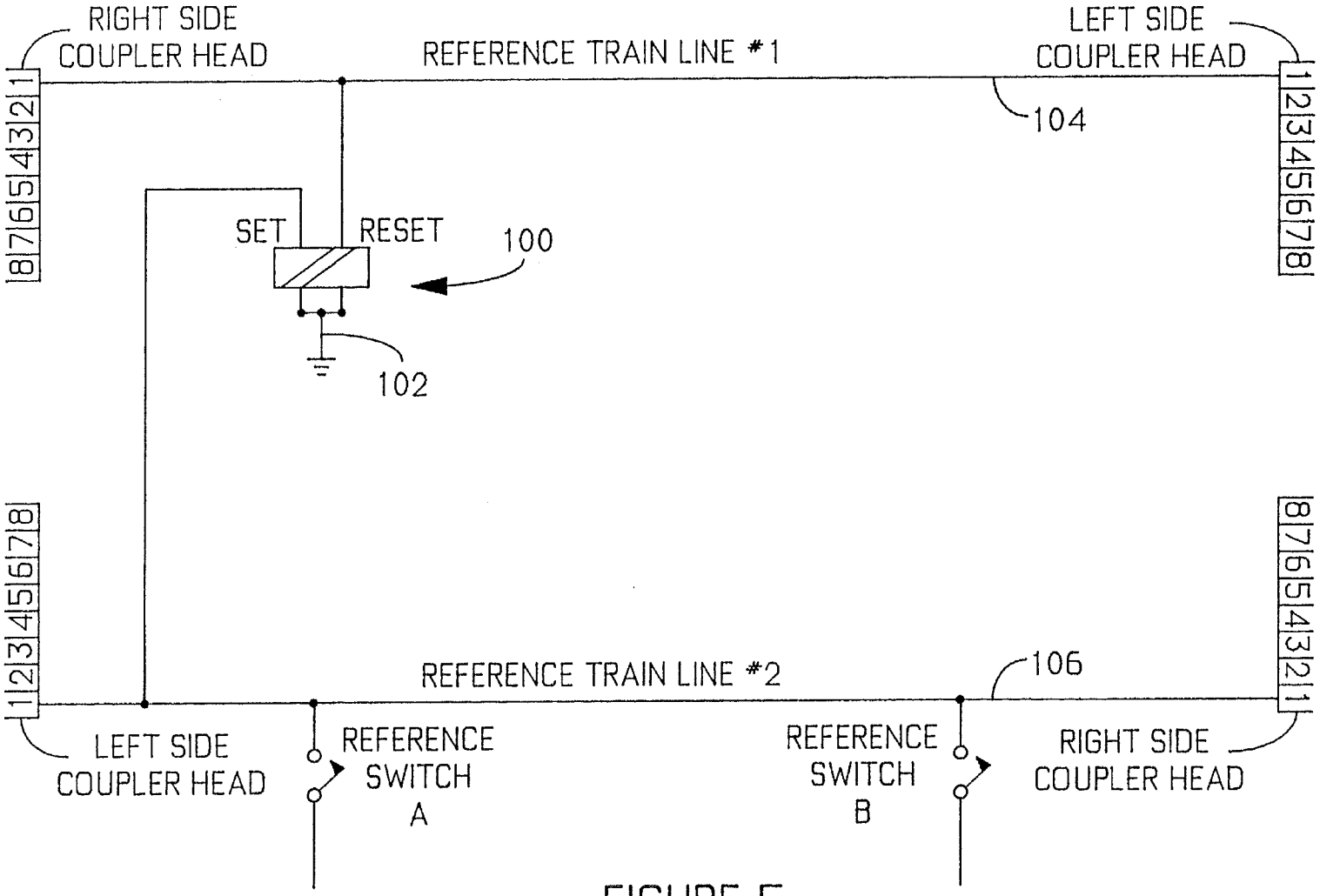

As a variant of the present invention, FIGS. 5 and 6 show the K1 relay being of the latching type where no change in state occurs when power is lost. In FIG. 5, a latching type relay 100 is shown connected to a ground and at a reset input thereof to a reference train line 104 and at a set input thereof to a reference train line 106. The contacts of the relay 100 and alarms A and B, train lines, etc. are the same as in FIG. 1. With the relay 100 "set" input powered by a voltage on the line 106, the relay's contacts are in the same position as shown in FIG. 1. With the relay's reset input powered by a voltage on the line 104, on the other hand, the relay contacts are opposite to the position shown in FIG. 1. Upon loss of power to both the set and reset lines 106, 104, the contacts remain in the last state. If the relay is set up in this way, train lines 32, 46 of FIG. 1 would remain in the correct configuration even if the relay coil failed or if a failure occurred in the voltage supply to the reference switches A and B. Transit trains often have critical functions tested before initial departure. If the K1 relay were a latching type, as suggested in FIG. 5, no failure which is likely to occur will cause an incorrect reconfiguration of the train lines after predeparture tests are performed.

Many other variations of the present invention are of course possible and within the scope thereof. For example, the need for reference train lines 1 and 2 could be eliminated, as shown in FIG. 6. If forward and reverse train lines are available, a K1 relay 110 of the latching type could be operated from these train lines, as shown. Such forward and reverse train lines are often installed and could be a convenient way to provide the desired set or reset since only the forward or reverse train line would be energized at any given time.

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

I claim:

1. An improved car for a train of similar cars connected end to end and having coupling means at each end for electrically connecting a plurality of train lines in each car of the train to a corresponding plurality of train lines in adjacent cars, the coupling means having mirror image coupler head halves having matched pair pins one of each pair on each half wherein an orientation of a car with respect to adjacent cars has no effect on the electrical connection of the train lines, wherein the improvement comprises connecting each train line to a pair of switches for each end of the car for switching the train line between one or the other of the mirror image coupler head halves, depending on the orientation of the car.

2. A connection for a plurality of train lines in each car of a train of cars having coupling means having mirror image halves at each end of each car for electrically connecting each train line in each car to a corresponding train line in an adjacent car regardless of the orientation of any car, wherein the connection comprises:

at least one relay connected to at least one mirror image half of the coupling means at each end, the relay having a plurality of contacts for alternatively connecting a pair of train lines to one or another of the mirror image halves of the coupling means; and a power node connected to the other mirror image half of the coupling means at each end for energizing the relay in the car or for energizing a relay in another car that is oriented differently from at least one other car, wherein the pair of train lines are switchable from one to the other of the mirror image halves of the coupling means, according to the orientation of the car with respect to the other cars in the train.

3. The connection of claim 2, wherein the at least one relay has form C contacts or equivalent formed from normally open and normally closed contacts.

4. The connection of claim 2, wherein the at least one relay is a latching relay.

5. Apparatus for each car of a train of cars, comprising:

a first coupler having a right coupler head half with a plurality of pins and a left coupler head half with a corresponding plurality of mirror image pins for a first end of the car;

a second coupler head having a second right coupler head half with a plurality of pins and a second right coupler head half with a corresponding plurality of mirror image pins for a second end of the car;

a plurality of nodes including at least a first node and a second node, each having an associated switch connected thereto for connecting a voltage to the node and having a lamp connected thereto for being illuminated upon closing of the switch;

at least one relay having at least four form C contacts or equivalent, a common node of each contact connected to a like numbered pin of an associated coupler head half, each contact having a pair of first and second alternative nodes wherein the common node is switchable therebetween for connection to the first or second node for a right coupler head half pin in the first coupler head and left coupler head half pin in the second coupler head and for connection to the first or second alternative node for the right coupler head half in the second coupler head and the left coupler head half in the first coupler head; and a pair of train lines for energizing the at least one relay in at least one car.

* * * * *